US006774790B1

(12) United States Patent
Houston

(10) Patent No.: US 6,774,790 B1
(45) Date of Patent: Aug. 10, 2004

(54) SOLAR POWERED PERIMETER BEAM

(76) Inventor: Robert B. Houston, 200 NE. 2nd Dr., Homestead, FL (US) 33030

( * ) Notice: Subject to any disclaimer, the term of this patent is extended or adjusted under 35 U.S.C. 154(b) by 0 days.

(21) Appl. No.: 09/955,941

(22) Filed: Sep. 20, 2001

Related U.S. Application Data

(60) Provisional application No. 60/234,310, filed on Sep. 21, 2000.

(51) Int. Cl.[7] ..... G08B 13/18

(52) U.S. Cl. ..... 340/556; 340/539.16; 340/539.17

(58) Field of Search ..... 340/693.1, 552, 340/555, 556, 557, 553, 554, 539.1, 539.16, 539.17, 541; 250/221

(56) References Cited

U.S. PATENT DOCUMENTS 4,191,953 A * 3/1980 Woode ..... 340/552
4,910,498 A * 3/1990 Feher ..... 340/556
4,978,942 A * 12/1990 Bruce ..... 340/556
5,552,767 A * 9/1996 Toman ..... 340/552 X
5,554,972 A * 9/1996 Byrne ..... 340/556
5,848,707 A * 12/1998 Hill ..... 340/557
6,114,963 A * 9/2000 Blake et al. ..... 340/556 X
6,118,375 A * 9/2000 Duncan ..... 340/556 X
6,127,926 A * 10/2000 Dando ..... 340/552 X

* cited by examiner

*Primary Examiner*—Thomas Mullen
(74) *Attorney, Agent, or Firm*—Krieg DeVault Lundy LLP

(57) ABSTRACT

A security system employs solar towers for detecting an intruder. The security system includes a receiver/processor and transmitter for communicating with electronic devices in the solar beam towers, the receiver/processor and transmitter having an antenna, a housing and an indicator. The indicator includes information on the location of an intrusion. A detection beam extending between adjacent towers is used to detect intruders. The detection beam can include infrared, laser, microwave, and visible light. The alarms sent out by the system can include devices such as visual alarms, audible alarms, telephone dialers, and printers. The central unit exchanges information between the remote units via two way half-duplex radio. The system is a radio data reporting system, which reports events and selectively transmits an alarm. The alarm is transmitted to the central unit when a new event is detected, and it is displayed there. The system includes a central unit board having indicators, working components including LED's and pushbuttons, and at least one remote unit board.

27 Claims, 10 Drawing Sheets

SOLAR POWERED PERIMETER BEAM

This application claims priority of provisional patent application Ser. No. 60/234,310 filed Sep. 21, 2000, entitled Solar Powered Perimeter Beam, and is incorporated by reference herein.

FIELD OF THE INVENTION

The present invention relates to a solar powered perimeter beam apparatus. More particularly, the invention relates to a solar powered perimeter beam apparatus for an intruder detection system, using a one-half duplex digital/analog transceiver that communicates from the remote towers to a central unit having a master control receiver.

BACKGROUND OF THE INVENTION

There are known types of solar powered systems, and it is a problem in the art to house solar-powered radio equipment. It is further a problem in the art to house a control system and power for solar-power photoelectric or microwave beam equipment.

U.S. Pat. No. 5,554,972 issued to Byrne teaches an electronic perimeter warning system. The apparatus provides transmitters and receivers powered by solar-powered batteries, and includes an alarm system.

U.S. Pat. No. 5,552,767 issued to Toman teaches an assembly for detecting and signaling when an object enters a zone. This system includes a solar powered warning signal actuation device and a plurality of transmitting sensor pairs linked together and stationed around the perimeter of an area to be protected.

U.S. Pat. No. 5,848,707 issued to Hill teaches a storage rack with position sensing. This patent shows a storage system which includes transmitters and receivers located in storage racks, and an alarm for signaling when a beam of radiation has been interrupted.

U.S. Pat. No. 4,191,953 to Woode teaches an intrusion sensor and aerial therefor. This patent includes a perimeter surveillance system having transmitters and receivers which use microwave frequencies of radiation.

SUMMARY OF THE INVENTION

According to the present invention, a device is provided which meets the aforementioned requirements and needs in the prior art. Specifically, the device according to the present invention provides a secure solar powered perimeter beam apparatus for an intruder detection system.

The security system employs solar towers for detecting an intruder. The Security system includes a receiver/processor communicating with electronic devises in the solar beam towers, the receiver/processor having an antenna, a housing, and an indicator. A detection beam is used to detect intruders. The detection beam may be a photo-electric beam, an infrared beam, a laser beam, a microwave beam or a visible light beam, or a combination thereof.

The security system employs solar towers for detecting an intruder. The security system includes a receiver/processor communicating with electronic devices in the solar beam towers, the receiver/processor having an antenna, a housing and an indicator. The indicator includes information on the location of an intrusion.

A detection beam is used to detect intruders. The alarms sent out by the solar powered perimeter beam security system apparatus may include devices such as an audible alarm, a visible alarm, a telephone dialer, a printer or a recording device. The central unit exchanges information between the remote units via two way half-duplex radio devices. The system is a radio data reporting system, which reports events and selectively transmits an alarm. An alarm is transmitted to the central unit when a new event is detected, and it is displayed there. The system includes a central unit board having indicators, working components including LED's and pushbuttons, and at least one remote unit board.

The solar tower preferably includes a 20 Watt solar panel, a stainless steel solar mounting bracket, a swivel clamping bolt, a swivel bracket O-ring, a swivel solar bracket, a solar cap O-ring, a solar cap opening mechanism, a solar base cap, and a stainless steel top plate. The solar tower also includes frame support rods, a frame unit, a six inch frame tower, face shields, a battery clamp, a base unit, and face shield slots.

Other objects and advantages of the present invention will be more readily apparent from the following detailed description when read in conjunction with the accompanying drawings.

DETAILED DESCRIPTION OF THE INVENTION

Figure 1:
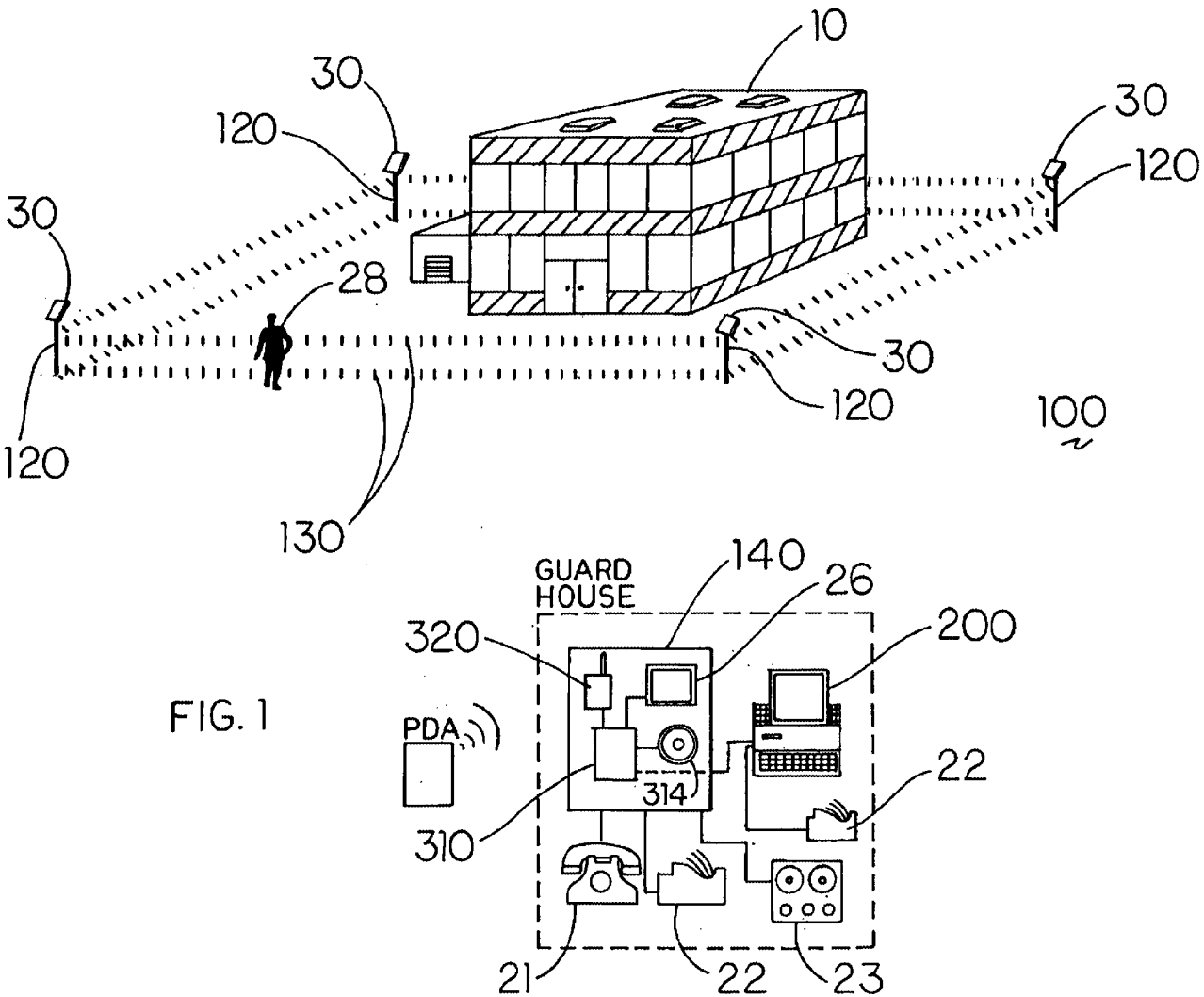
FIG. 1 depicts a security system employing solar towers for emitting a detection beam and a remote central unit, according to the present invention.

FIG. 1 is a perspective view illustrating a security system 100 employing solar towers 120, for detecting an intruder 28 in a perimeter about a desired location, such as a private building 10. The security system 100 includes a receiver/processor and transmitter unit 20 coordinating a plurality of electronic devices in the solar beam towers 120. In the security system 100 of FIG. 1, a photo-electric detection beam 130 is used to detect intruders; however, an infrared beam, a laser beam, a microwave beam or a visible light beam, or any combination of detection beams may be used.

The alarms sent out by the solar powered perimeter beam security system 100 comprise at least one of: an audible alarm, a visual alarm, a telephone dialer 21 for calling a particular telephone and/or pager number or numbers, a printer 22 and a recording device 23. The security system 100 further comprises a remote central unit 140 that communicates with each tower 120. In one embodiment, the central unit 140 comprises a radio transmission/reception device 320 that communicates with each receiver/processor and transmitter unit 20. In other embodiments, the receiver/processor and transmitter units 20 and the radio transmission/reception device 320 communicate via respective two way half-duplex radios. The solar powered perimeter beam security system 100 according to the present invention is a radio data reporting system, which reports events and transmits a signal when the detection beam 130 is breached. The detection signal is transmitted to the central unit 140 when a new event is detected, and it is displayed there in conjunction with one or more alarm functions described above.

The security system 100 is a supervised-wireless perimeter security detection system for outdoor applications. The security system 100 provides easy deployment and installation.

The security system 100 includes a plurality of solar towers 120 and the detection beams 130 extending between adjacent solar towers 120. Detection beams 130 are generated and emitted from one tower 120 and detected by adjacent towers 120 by aligned detection beam generator/detectors 134. The generator/detectors 134 are connected to the receiver/processor and transmitter units 20 which are programmably configured to receive signals from the generator/detectors 134 regarding breach of a beam 130 emitted from an adjacent tower 120. The unit 20 transmits such signals to the device 320 of the central unit 140, including information identifying the location of the beam 130 that has been breached and/or the location of the corresponding towers 120. Detection beams 130 define an intruder detection area extending between adjacent towers 120.

The parts used in the solar towers 120, described below, are preferably constructed of polycarbon plastic. Any other suitable materials, within the ambit of one ordinarily skilled in this art, are also contemplated as being within the scope of the present invention.

Figure 2:
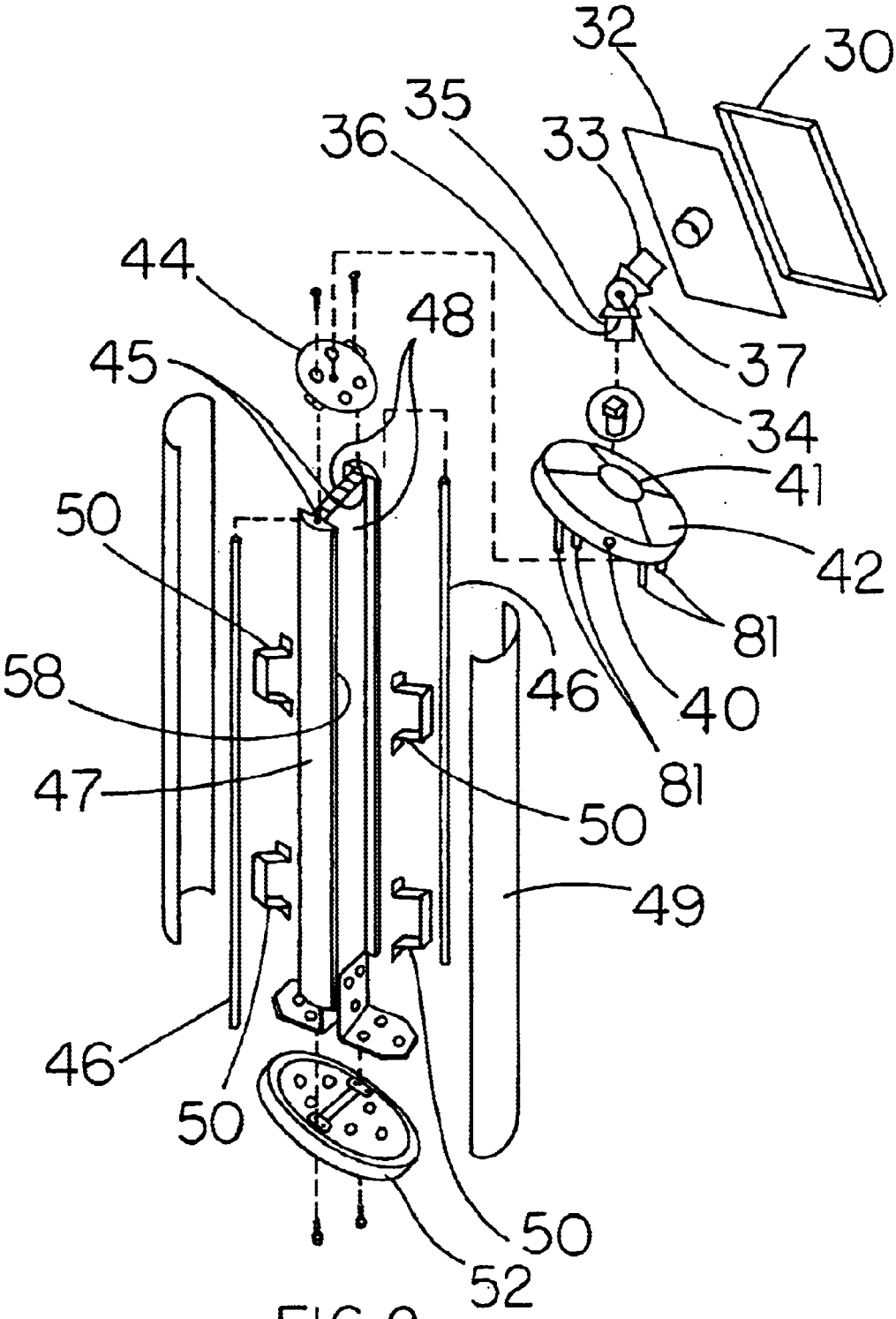
FIG. 2 is an assembly view of a solar tower according to the present invention.

FIG. 2 is an assembly view of one of the solar towers 120. The security system 100 of FIG. 2 includes a 20 Watt solar panel 30 having a solar array 31 for collecting solar energy and generating electrical energy therefrom, a stainless steel solar mounting bracket 32, a swivel clamping bolt 34, a swivel bracket O-ring 36, a swivel solar bracket 37, a solar cap O-ring 38, a solar cap opening mechanism 40, a solar base cap 42, and a stainless steel top plate 44. The security system 100 also includes frame support rods 46, a frame unit 47, at least one frame face 48, face shields 49, a battery clamp 50, a base unit 52, and face shield slots 58.

The stainless steel solar mounting bracket 32 is mounted to the top of the swivel solar bracket 37, and the power cable from the solar array 31 on the solar panel 30 passes through the center of the bracket 32 into the top of the swivel solar bracket 37. The swivel solar bracket 37 comprises a two-piece polycarbon swivel bracket that clamps together and rotates about the bolt 34 and O-ring 38 to allow the solar array panel to be positioned at different angles for viewing the sun. The top piece 33 of the bracket 37 attaches to the bottom piece 35 of the solar mounting bracket 37, and the bottom piece 35 will be inserted inside the top portion 41 of the solar base cap 42.

The solar base cap 42 and the solar cap opening mechanism 40 (located inside the housing of the cap 42) permit access into the tower 120. A special key may be used, for example, to raise and lower the solar cap 42, using a drill or a screw-type shaft positioned in the center of the solar cap 42. A plurality of alignment pegs 81 allow the solar cap 42 to move freely up and down. A recessed opening in the solar cap 42 receives the bottom piece 35 of the swivel solar bracket 37 along with electrical connectors extending between the solar panel 30 and a battery source for the electrical devices in the tower 120.

Bolts are used to clamp together the top plate 44, the frame support rods 46, and the frame unit 47. The frame unit 47 has a substantially vertical main body which comprises rod channels 45 that receive the frame support rods 46 which attach to the base unit 52 at bottom ends thereof. The top plate 44 bolts to the support rods 46 at top ends thereof, giving all three components strength as needed. Open channels inside the solar tower 120 frame allow for the wiring of the unit 20 and other electrical devices to be mounted on the solar tower 120 frame 47. One or more faces 48 comprise generally vertical and generally planar surfaces configured for mounting the unit 20, other components, as well as battery clamp 50.

The base unit 52 in one embodiment comprises an oval-shaped polycarbon member which is about eight inches wide, twelve inches long, and two inches high. The base unit 52 may be used to secure the main solar tower 120 frame to the ground. In addition, the base unit 42 bolts to the support rods 46 to clamp the solar tower 120 frame unit together.

The security system 100 also includes one or more face shields 49 configured to cover and protect each face 48 and the components mounted thereon. Face shields 49 permit beams 130 to be emitted therethrough. In one embodiment, face shields 49 are made of polycarbon plastic, and are U-shaped (i.e. shaped in a half-oval pattern). In other embodiments, face shields are about 5 and one-half inches wide and about six feet high. Face shields 49 are mounted to the frame unit 47. The face shields 49 in one embodiment are inserted into the base unit 52 first. Then, the face shields 49 are inserted into channels in the frame unit 47. The frame support rods 46 are preferably aluminum poles six feet high and three-fourths inches in diameter. At each end of the rods 46 are welded-on nuts that bolt the base plate (base unit 52), the frame unit 47, and the top plate 44.

Figure 3:
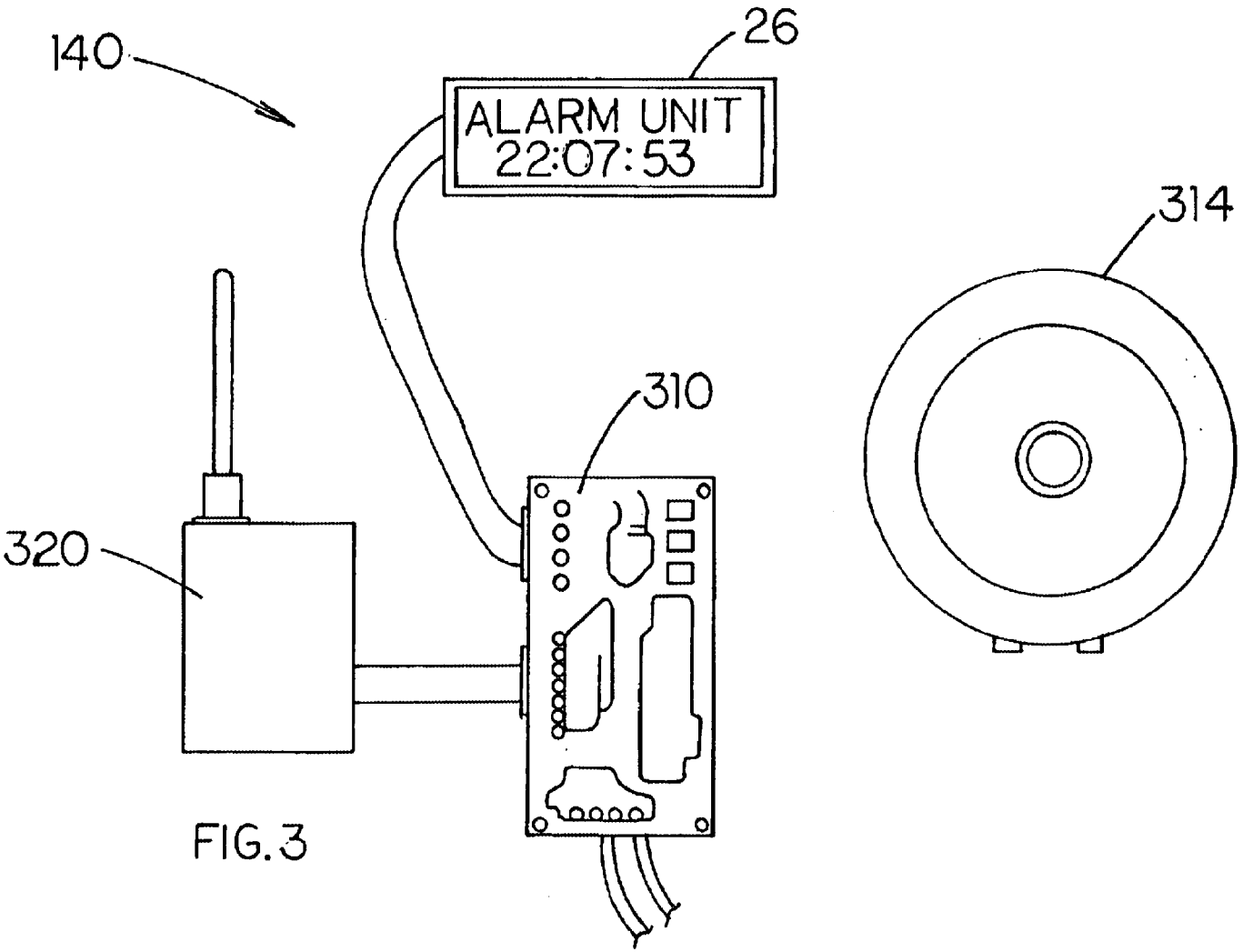
FIG. 3 is a front view illustrating a central unit circuit board, a radio transmission/reception device, a display and a speaker for a security system according to the present invention.

FIG. 3 is a front elevational view of an embodiment of a central unit 140 having a central unit circuit board 310 and a radio transmission/reception device 320. A display 26, and a speaker 314 used to sound an alarm may further be provided with the central unit 140, connected to the circuit board 310. The radio transmission/reception device 320 in one embodiment comprises an FM RTX radio. The central unit 140 in one embodiment includes at least two half duplex two-way radios that comprise the radio transmission/reception device 320. This type of half-duplex system substantially prevents sabotage and detects intentional radio jamming. In other embodiments, the central unit circuit board 310 includes a CPU 311 therein which communicates with the display 26 to indicate time, actions, and status of components mounted on the towers 120 (digital alarms and analog signals, battery voltage and board temperature). The CPU 311 in the central unit circuit board 310 has sufficient memory to provide capability of storing events and printing them on an external standard printer 22.

One having ordinary skill in the two-way radio transmission art would understand how to embody the elements and connections necessary to carry out the above-described functions.

Figure 4:
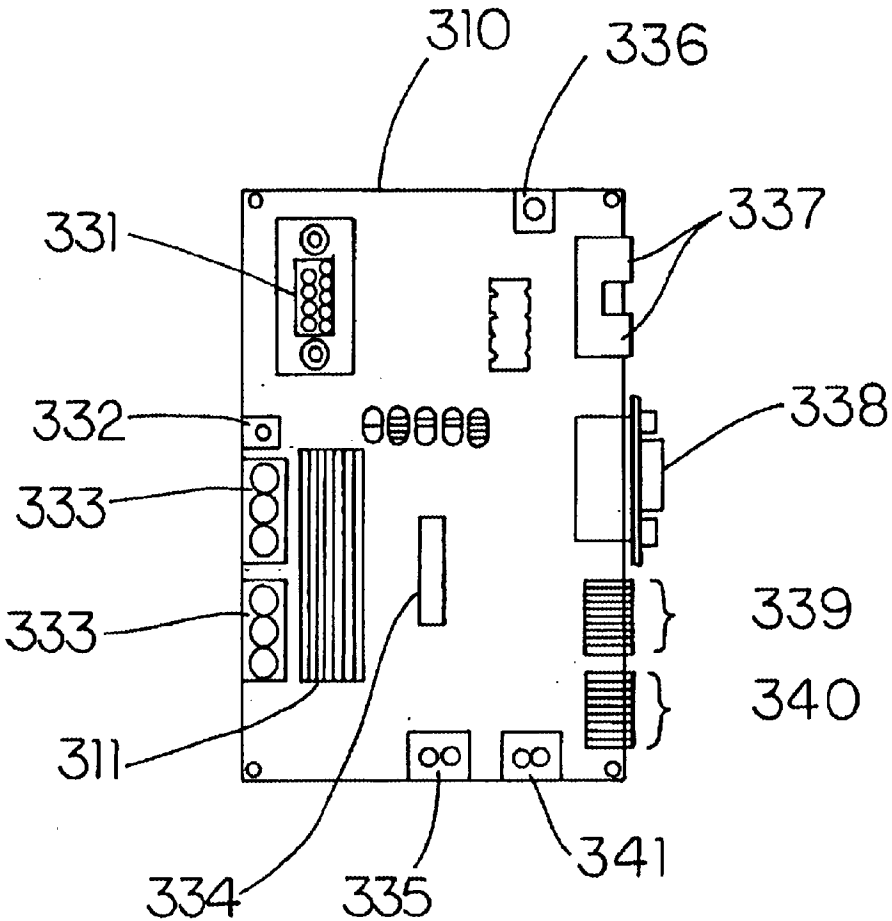
FIG. 4 is a front view of the central unit circuit board illustrating connections for various working components to be connected to the back side of the central unit circuit board of FIG. 3.

FIG. 4 is a perspective view of one embodiment of connections for various working components to be connected to the circuit board 310. The central unit circuit board 310 of FIG. 4 includes a programming socket 331 for connecting to an external PC 200, a speaker output connection 332 for aural alarm indications, and an alarm relay output connection 333.

The central unit circuit board 310 may also include connections for one or more of a clock battery 334, a 12 V dc battery 335, a display contrast control 336, and a display/printer output port 337. The central unit circuit board 310 may further include a connector for an FM radio 338, a connector for an CPM-016-FM radio 339, a connector for an CPM-016-AM radio 340 (which is a connection for a standard ON-OFF-keying half-duplex radio), and a supply/charger connection 341 which in one embodiment is made for connection to a source of voltage in the range of 14.5 volts DC to 18 volts DC and which is switchable to put the unit ON/OFF.

In FIG. 4, the connector programming socket 331 is used to program the central unit circuit board 310 by an external P.C. 200. In other embodiments, the central unit circuit board 310 comprises an external P.C. 200 communicatively connected to the radio transmission/reception device 320 via circuit board 310. In yet other embodiments, the central unit circuit board 310 or the P.C. communicates with the receiver/processor and transmitter units 20 at each tower 120 through the radio transmission/reception device 320. In yet other embodiments, a remote control unit, such as a wirelessly connected PDA unit, is used to control the security system 100 through the central unit 140.

Figure 5:
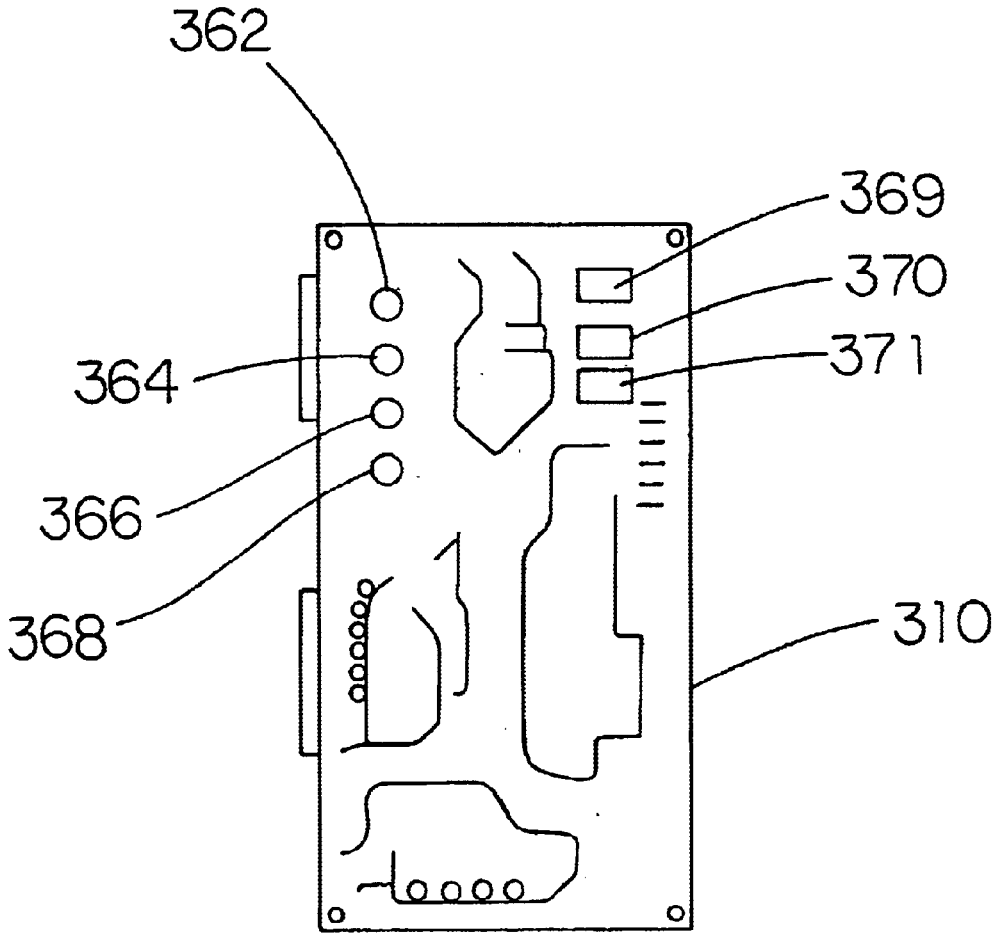
FIG. 5 illustrates various LED's and pushbutton control features on the front side of the central unit circuit board.

FIG. 5 illustrates one embodiment of the central unit 140 having LED's and pushbuttons on the central unit circuit board 310. Specifically, FIG. 5 shows that the central unit circuit board 310 includes an "ON" LED 362 which is lit when the battery and/or power supply is present on the board 310, a "CLOCK" LED 364 (flashing at one pulse per second, indicating that the CPU is working), and an alarm memory LED 366 which is "ON" when a signal for an alarm has been detected and not yet reset.

The central unit circuit board 310 of FIG. 5 also shows a fault memory LED 368 which is "ON" when a telemetry fault has been detected and is not yet reset, and a reset button 369 which can be pushed to test the whole system after an alarm signal or fault detection, in which a polling cycle will be executed to all remotes. The central unit circuit board 310 of FIG. 5 also includes a clock/up button 370 and a set clock button 371.

The buttons 370 and 371 are preferably used in combination to set a time, or change a time. Such operations, in many variations, are well known and are therefore not described further herein. It would be within the ambit of one having skill in the digital clock setting and control arts to configure, design, and/or make such a clock setting arrangement.

Figure 6:
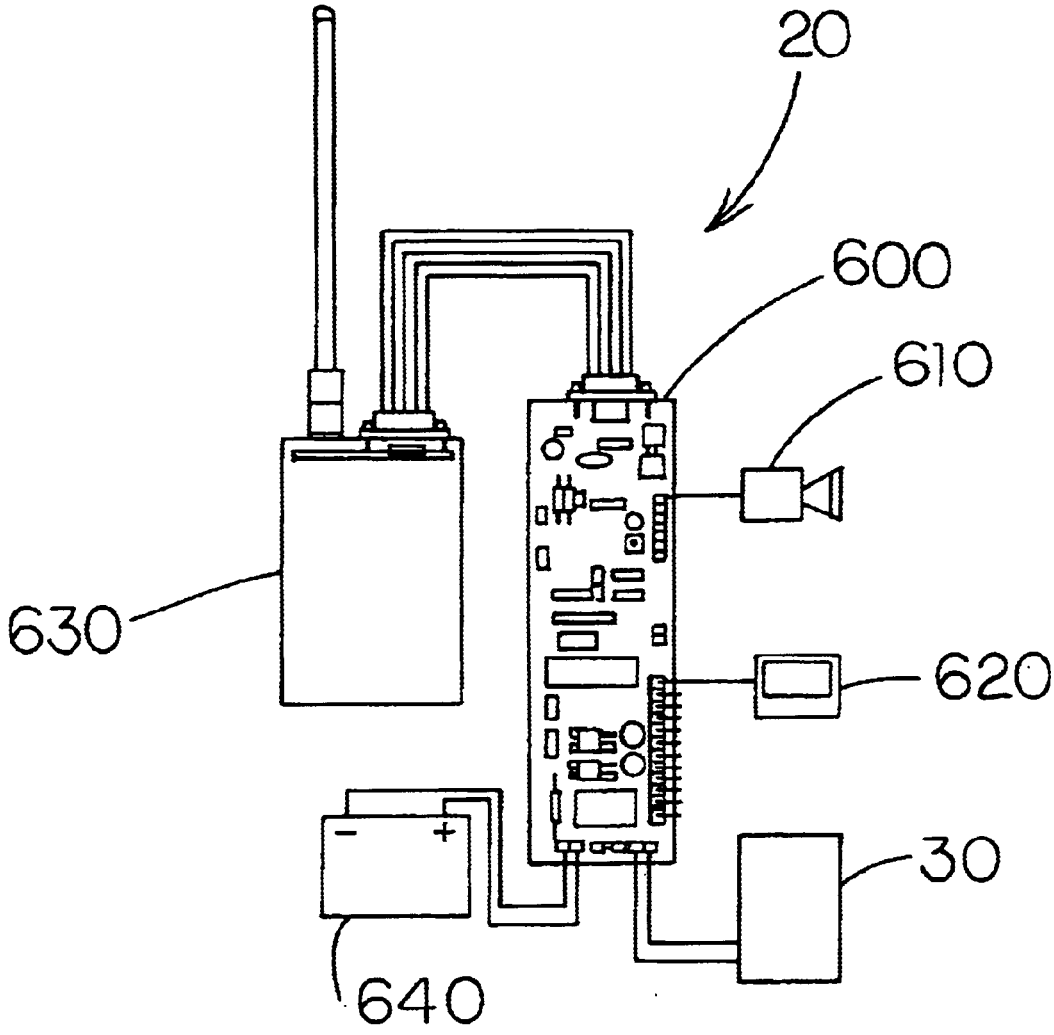
FIG. 6 illustrates an embodiment of the receiver/processor and transmitter unit having a radio transceiver unit, a remote controlled camera and detector.

FIG. 6 illustrates an embodiment of a receiver/processor and transmitter unit 20 comprising a remote unit board 600 and associated devices. Specifically, FIG. 6 shows a radio transceiver unit 630, a remote controlled camera 610, ad a radiation or motion detector 620, a microphone/speaker unit 622, and a light 624. The remote unit board 600 is preferably a CPU-equipped PC Board having 12 V dc operation, a solar-panel/charger circuit, three different radio interfaces, a temperature sensor, a battery voltage sensor, four analog input channels (two of which are for temperature and battery voltage), a settable threshold for the four channel analog IN to generate an alarm, an eight digital alarm in -optical decoupled -normally low, a bi-directional polling and/or simple one-way only transmission (using dip switch settings), dip switch time settable telemetry transmission in the "only tx" equipped systems, a local check up capability to test the radio reception, and remote unit identification by dip-switch settings.

Figure 7:
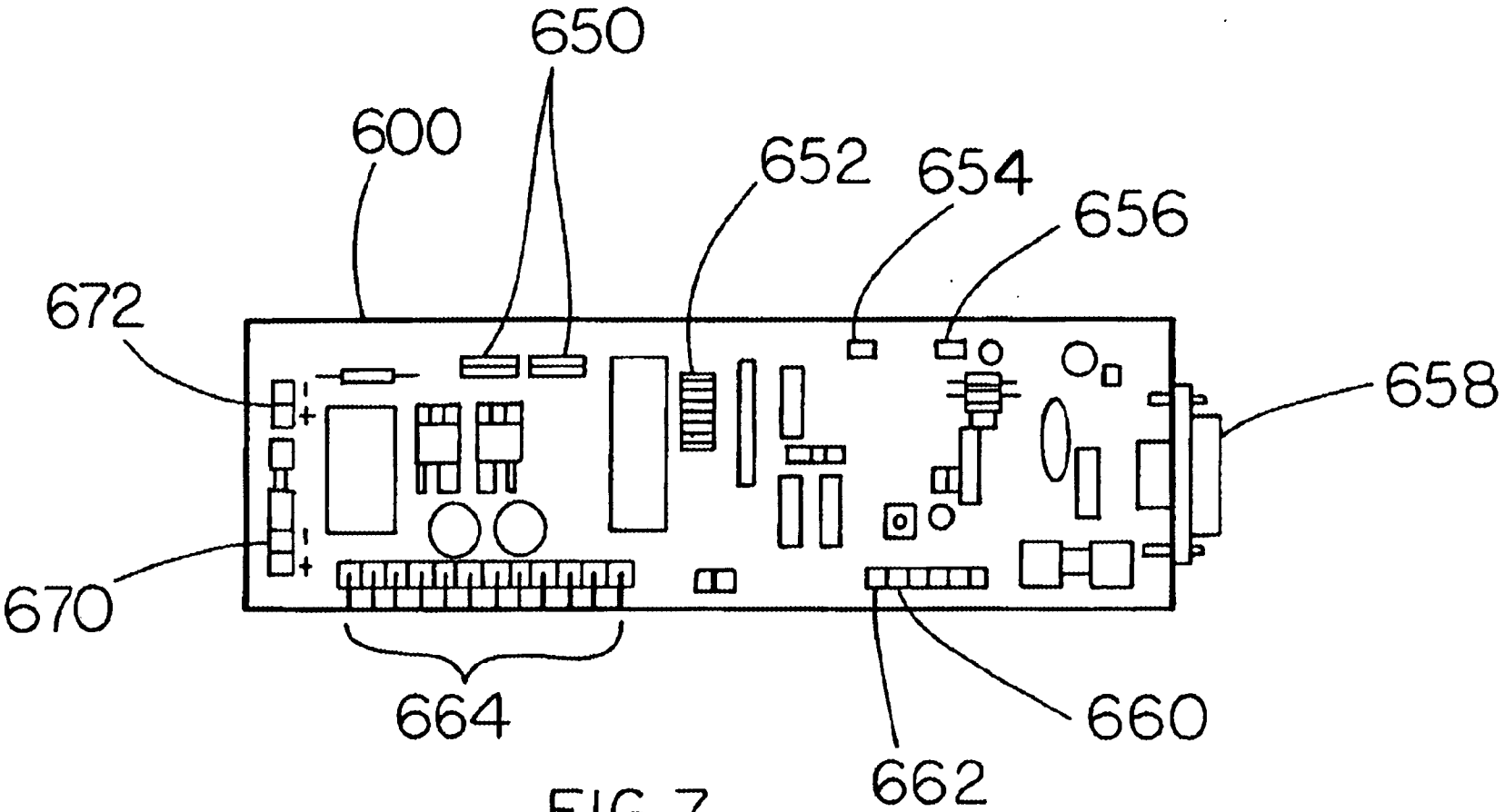
FIG. 7 is a front view of the remote unit board illustrating connections for various working components to be connected to the remote unit board of FIG. 6.

FIG. 7 illustrates an embodiment of possible connections on the remote unit board 600 of FIG. 6 for various components. In one embodiment, the remote unit board 600 includes a relay out 650 for contacts out for a remote command from the central unit 140 (to switch ON/OFF a radio, camera 610, flashlight 624, etc.), a connection for an ID number 652, a connection for a CPM-AM radio 654, a connection for a CPM-FM radio 656, a connection for an FCC FM radio 658, a reset button/switch 660, and a connection 662 for receiving/transmitting a setting and a transmission time. The remote unit board 600 also includes a digital and an analog "in" connection 664, a charger/solar panel power "in" connection 670 and a 12 V dc battery "in" connection 672.

In one embodiment, at the connection 664, it is possible to connect with eight digital alarm signal inputs and two analog sisal inputs (0.25 V dc ground ref., 0.1 V dc res.). To generate an alarm signal, the digital input must be between 5 and 18 Volts dc, at 10 mA.

Figure 8:
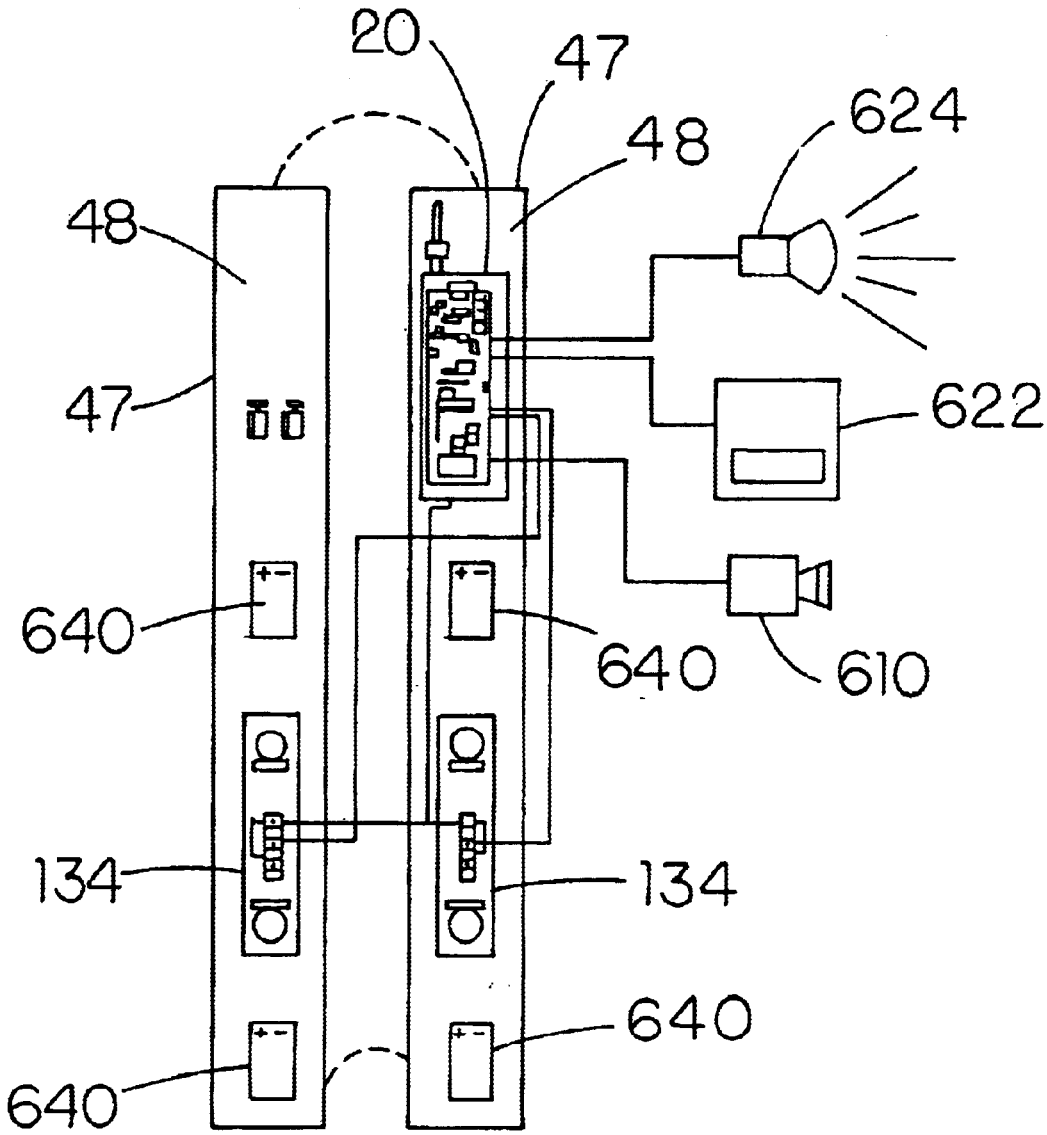
FIG. 8 is a split view of two faces on a solar tower beam unit as shown in FIG. 2, and carrying the electronic elements thereon.

FIG. 8 is an elevational view of two back-to-back (as shown by the dotted lines) faces 48 of a solar tower beam unit as in FIG. 2, with the face shield 49 removed and carrying the various electronic elements thereon. Electrical connections between components are also shown.

Figure 9:
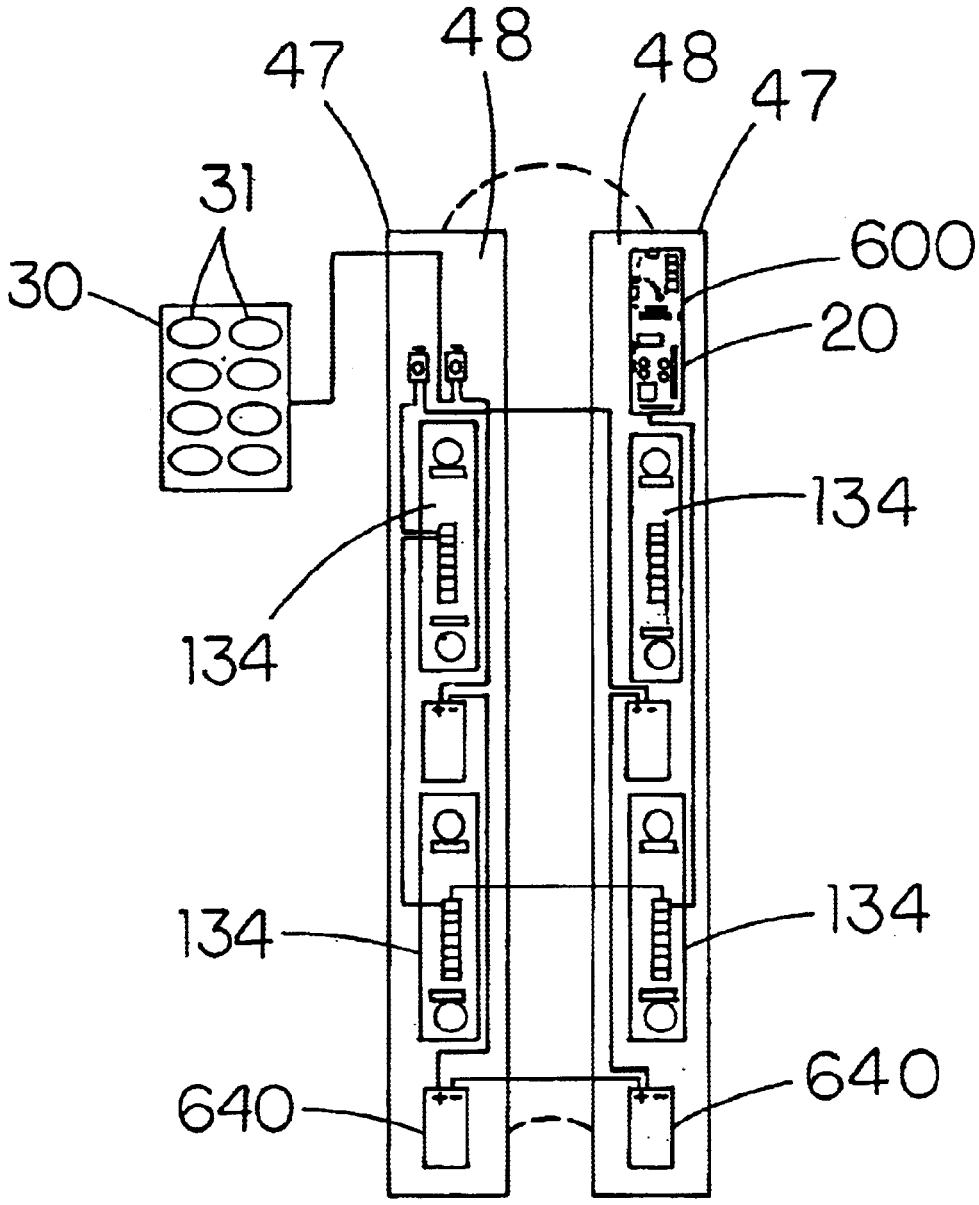
FIG. 9 is a split view of the solar tower beam unit of FIG. 8 showing the electrical power supply connections therein.

The solar power security system 100 is a supervised, wireless perimeter security detection system for outdoor application, featuring easy deployment and installation. Individual solar towers 120 are custom designed to cover the intruder detection area to be protected, including the features and options selected. The solar towers 120 are supported by their respective base units 52 which may further be secured to the ground such as by bolting to a concrete footing (not shown), the beam generator/detectors 134 are aligned, and the central unit 140 is powered up. Electrical connections for the power supply in each tower 120 are shown in FIG. 9.

Figure 10:
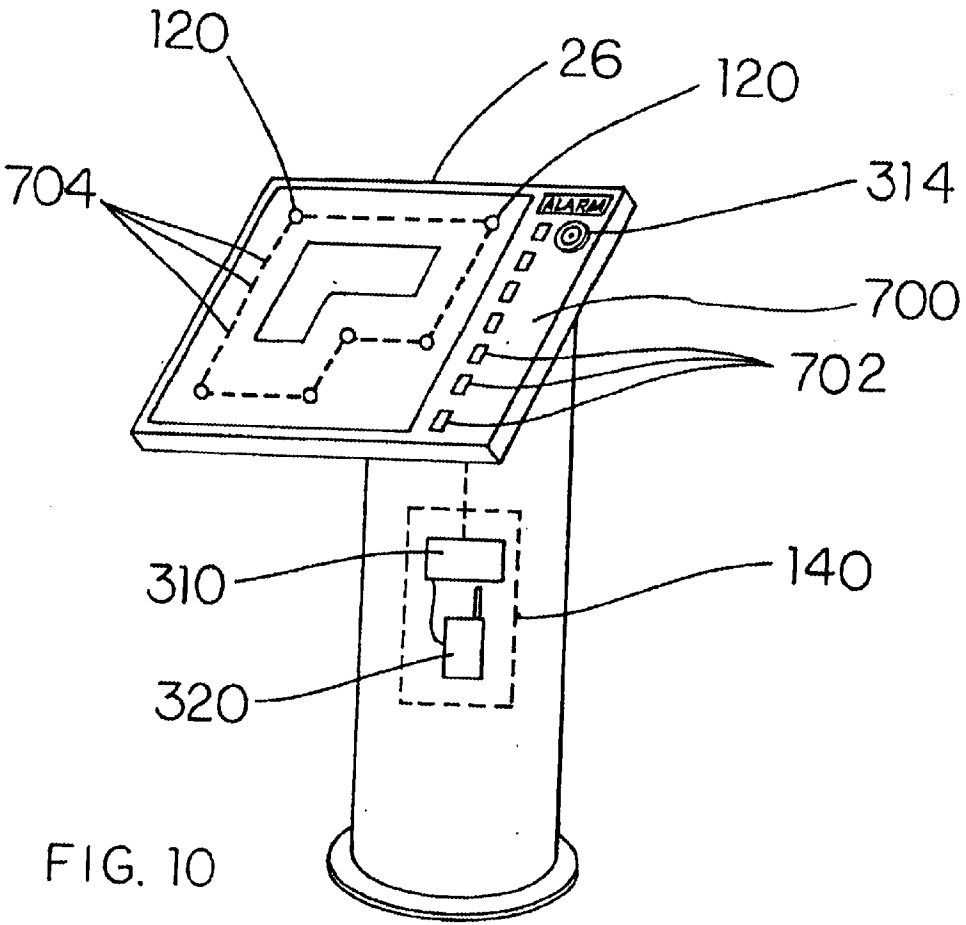
FIG. 10 is a perspective view of an embodiment of a display panel for a central unit.

The central unit 140 is installed in a guardhouse or other central monitoring location. As shown in FIG. 10, in one embodiment, a display panel 26 is connected to the central unit 140 comprising a perimeter light and voice annunciation system that will disclose the exact zone and location of any alarm signal received from the units 20 at one or more towers 120. Red 702 and yellow 704 LED lights located around the display panel 26 will show all activity in the intruder detection areas between the solar beam towers 120. In one embodiment, the red light LEDs 702 indicate an alarm condition and the yellow light LEDs 704 represent the zone(s) bypassed. An RS 232 connection port may be provided for remote video camera signals.

In one embodiment, the central unit 140 will have the ability to send and receive information by duplex transmission, and is programmed to provide a complete status of the perimeter security system 100. Bypass buttons and other sounding devices may be installed in the display panel 26. All ancillary functions, such as low battery, signal loss, and alarm signals from any tower 120 may also be visible on the display panel 26.

In addition to the display panel 26, the radio transmission/reception device 320 in one embodiment can interface with a standard PC computer and software installed thereon. The device 320 works much like the radio transceiver units 630 of the units 20 located in the solar towers 120. The device 320 and the radio transceiver units 630 use standard FCC approved transmitters, which are connected to circuit boards 310 and 600. The boards 310, 600 send and receive dialog between the beam towers 120 and the central unit 140, such as any necessary information requiring output to the display panel 26 and/or computer.

In one embodiment, the device 320 and the radio transceiver units 630 comprise three to five mile, five watt radio transmitters. A decoder may be attached to the radio transmitter via RS 232 cable. The decoder in the radio transceiver units 630 receives dialog from the beam generator/detectors 134, which in one embodiment comprise a Pulnix BPIN200HF, and transmits this information to the device 320. Radio transmitters at both the radio transceiver units 630 and the device 320 communicate in duplex mode between the tower(s) 120 and the central unit 140. This allows the central unit 140 to send a signal to the receiver/processor and transmitter unit 20 at a tower 120 to verify its status, or to activate the remote camera, check voltage on batteries, or turn on a microphone/speaker module to hear from and talk to the tower 120, if needed.

The remote control camera 610 plugs into the receiver/processor and transmitter unit 20, and when actuated, will photograph the activity or violation, and transmit the digital image to the central unit 140 located at the guardhouse for printing and documentation. Both still photographs and video transmission are to be considered within the scope of this disclosure.

When a person or vehicle interrupts a beam path 130 extending between adjacent towers 120, a signal is sent from the generator/detector 134 to the receiver/processor and transmitter unit 20, which in turn transmits a telemetry radio signal to the central unit 140, designating the exact zone or location of the alarm signal. The central unit 140 may be designed to notify security personnel via voice and zone display, telephone, beeper, remote control unit (such as a PDA) hand-held radio or to a 24-hour central station.

The beam 130 in one embodiment comprises a point-to-point multi-level quad beam defining a multi-level intruder detection area, having a range of up to 600 feet to 800 feet from tower 120 to tower 120. In other embodiments, all four beams 130 must be broken simultaneously to activate an alarm. This eliminates false alarms when birds, dogs or other animals pass through the beam.

Alternately, a microwave unit may be used in a more controlled area, such as prisons or high security level applications. The microwave unit offers total perimeter coverage in the intruder detection area, but at a range of from fifteen feet to 150 feet from tower to tower.

The radio communication system utilized by the device 320 and the radio transceiver units 630 can be of several types of systems, depending on the application or range needed. One such system is a short range radio with a range of approximately 1,500 feet from tower 120 to central unit 140. Another system is a long range transmitter, having a range of up to five miles.

The invention being thus described, it will be evident that the same may be varied in many ways. Such variations are not to be regarded as a departure from the spirit and scope of the invention and all such modifications are intended to be included within the scope of the claims.

What is claimed is:

1. A solar powered perimeter beam security system which comprises:

a) a receiver/processor and transmitter unit configured for radio communications, one said unit being mounted on each of a plurality of towers;

b) a detection beam generated by a detection beam generator/detector connected to each said unit, said beam extending between adjacent towers to define an intruder detection area;

c) a central unit remote from said towers comprising a radio transmission/reception device for communicating with each of the receiver/processors and transmitter units;

d) an alarm connected to said central unit and responsive to a breach in each detection beam;

e) a solar panel on each of said plurality of towers; and f) a battery source in electrical communication with each solar panel for storage of energy generated by the solar panel, said battery source independently powering the receiver/processor and transmitter unit and the detection beam generator/detector at each tower.

2. The solar powered perimeter beam security system of claim 1, wherein the beam comprises at least one of: a photo-electric beam, an infrared beam, a laser beam, a microwave beam and a visible light beam.

3. The solar powered perimeter beam security system of claim 1, wherein the alarm comprises at least one of: an audible alarm, a visual alarm, a telephone dialer, a printer, and a recording device.

4. The solar powered perimeter beam security system of claim 1, wherein each receiver/processor and transmitter unit communicates and exchanges data with the central unit via a two way, half-duplex radio device.

5. The solar powered perimeter beam security system of claim 1, wherein the central unit further comprises at least one remote control unit.

6. The solar powered perimeter beam security system of claim 1, wherein the solar panel is a 20 Watt solar panel having a solar panel bracket and a swivel clamp adapted to mount and orient the solar panel on the tower.

7. The solar powered perimeter beam security system of claim 1, wherein the receiver/processor and transmitter unit comprises a circuit board connected to a radio transceiver unit communicating with the radio transmission/reception device of the central unit, said circuit board comprising a plurality of connections for said radio transceiver and at least one of: a power supply, inputs from the beam generator/detector, relay contacts for sending and receiving on/off commands to and from said central unit, a temperature sensor, a battery voltage sensor, at least one analog input channel, at least one digital input channel, a camera, a microphone/speaker unit, a flashlight, and at least one additional radio interface.

8. The solar powered perimeter beam security system of claim 7, wherein said circuit board comprises a CPU-equipped PC board having 12V dc operation and is configured for use in a PC and interacting with software installed on said PC.

9. The solar powered perimeter beam security system of claim 1, wherein each said receiver/processor and transmitter unit comprises at least two half duplex radio transmission/reception devices each half duplex radio transmission/reception device comprising an FM RTX radio device.

10. The solar powered perimeter beam security system of claim 1, wherein the central unit further includes a CPU which communicates through said radio transmission/reception device with each receiver/processor and transmitter unit located upon each of said plurality of towers.

11. The solar powered perimeter beam security system of claim 1, wherein at least one receiver/processor and transmitter unit mounted on each of the plurality of towers includes a remote controlled camera connected thereto.

12. The solar powered perimeter beam security system of claim 11, wherein each receiver/processor and transmitter unit communicates in duplex mode with the central unit, the central unit being programmed to send a signal to the receiver/processor and transmitter units to verify status, and to selectively actuate the remote controlled camera, verify battery voltage, and actuate a microphone/speaker unit connected to the receiver/processor and transmitter unit to hear from and talk to a tower selected from the plurality of towers.

13. The solar powered perimeter beam security system of claim 11, wherein the remote controlled camera comprises at least one of: a still photographic camera and a video camera.

14. The solar powered perimeter beam security system of claim 1, wherein the detection beam comprises a photoelectric point-to-point multi-level beam with a range of up to 800 feet between adjacent towers.

15. The solar powered perimeter beam security system of claim 1, wherein the detection beam comprises a microwave beam providing total perimeter coverage in the intruder detection area, with a range of up to 150 feet between adjacent towers.

16. The solar powered perimeter beam security system of claim 1, wherein the detection beam comprises a short range radio beam with a range of up to 1,500 feet between adjacent towers.

17. The solar powered perimeter beam security system of claim 1, wherein the detection beam comprises a long range radio beam with a range of up to five miles between adjacent towers.

18. The solar powered perimeter beam security system of claim 1, wherein each said tower comprises a solar panel mounted to a solar mounting bracket, said bracket being mounted to a two-piece swivel bracket at an upper end of said swivel bracket, a lower end of said swivel bracket being mounted to a top portion of a solar base cap, said solar base cap comprising a recessed opening configured to receive electrical connectors extending from said solar panel to said battery source, said solar base cap further comprising a plurality of alignment pegs extending generally downwardly therefrom, said pegs being connected to a top plate, said top plate being configured for being connected to top ends of a frame unit and a plurality of support rods received within rod channels in said frame unit, bottom ends of said frame unit and said support rods being connected to a base unit configured for securement to a ground surface, said frame unit comprising at least one generally vertical and generally planar face, each said face being configured for mounting said receiver/processor and transmitter unit and said beam generator/detector thereto, said frame unit further configured for mountingly receiving a face shield configured to cover each said face and to permit said detector beam to be emitted therethrough.

19. The solar powered perimeter beam security system of claim 1, wherein the central unit further comprises a circuit board connected to the radio transmission/reception device and a display panel connected to the circuit board, said display panel configured with at least one of visual and aural means for disclosing locations of activity in the intruder detection area, the circuit board comprising a plurality of connections comprising at least one of a programming socket for connection to a PC, a speaker output connection, an alarm relay output connection, a clock battery connection, a 12 V dc battery connection, a display contrast control, a display/printer output port, an FM radio connector, a CPM-016-FM radio connector, a CPM-016-AM radio connector, and a supply/charger connector.

20. The solar powered perimeter beam security system of claim 19, wherein said circuit board further comprises a plurality of LED's and pushbuttons comprising at least one of an "ON" LED, a "CLOCK" LED, an alarm memory LED, a fault memory LED, a reset button, a clock/up button and set clock buttons.

21. The solar powered perimeter beam security system of claim 19, wherein said circuit board is configured for use in a PC and interacting with software installed on said PC.

22. A solar powered perimeter beam security system which comprises:

a receiver/processor and transmitter unit configured for radio communications and mounted on each of a plurality of towers;

b) a detection beam generated by a detection beam generator/detector connected to each said receiver/processor and transmitter unit, said detection beam extending between adjacent towers to define an intruder detection area, said detection beam comprising at least one of: a photo-electric beam, an infrared beam, a laser beam, a microwave beam and a visible light beam;

c) a central unit remote from said towers comprising a radio transmission/reception device communicating with each of the receiver/processors and transmitter units, said central unit further comprising a CPU communicating with each receiver/processor and transmitter unit through said radio transmission/reception device;

d) an alarm connected to said central unit and responsive to a break in each detection beam, said alarm comprising at least one of: an audible alarm, a visual alarm, a telephone dialer, a printer and a recording device;

e) a remote controlled camera connected to at least one of said receiver/processor and transmitter units, said remote controlled camera comprising at least one of: a still photographic camera and a video camera;

f) a solar panel on each of said plurality of towers; and g) a battery source in electrical communication with each solar panel for storage of energy generated by the solar panel, said battery source independently powering the receiver/processor and the beam generator/detector at each tower.

23. The solar powered perimeter beam security system of claim 22, wherein each said receiver/processor and transmitter unit comprises at least two half duplex radio transmission/reception devices, each half duplex radio transmission/reception device comprising an FM RTX radio device.

24. The solar powered perimeter beam security system of claim 22, wherein each receiver/processor and transmitter unit communicates in duplex mode with the central unit, the central unit being programmed to send a signal to the receiver/processor and transmitter units to verify status, and to selectively actuate the remote controlled camera, verify battery voltage, and actuate a microphone/speaker unit connected to the receiver/processor and transmitter unit to hear from and talk to a tower selected from the plurality of towers.

25. The solar powered perimeter beam security system of claim 22, wherein each said tower comprises a solar panel mounted to a solar mounting bracket, said bracket being mounted to a two-piece swivel bracket at an upper end of said swivel bracket, a lower end of said swivel bracket being mounted to a top portion of a solar base cap, said solar base cap comprising a recessed opening configured to receive electrical connectors extending from said solar panel to said battery source, said solar base cap further comprising a plurality of alignment pegs extending generally downwardly therefrom, said pegs being connected to a top plate, said top plate being configured for being connected to top ends of a frame unit and a plurality of support rods received within rod channels in said frame unit, bottom ends of said frame unit and said support rods being connected to a base unit configured for securement to a ground surface, said frame unit comprising at least one generally vertical and generally planar face, each said face being configured for mounting said receiver/processor and transmitter unit and said beam generator/detector thereto, said frame unit further configured for mountingly receiving a face shield configured to cover each said face and to permit said detector beam to be emitted therethrough.

26. A solar powered perimeter beam security system which comprises:

a) a receiver/processor and transmitter unit configured for radio communications and mounted on each of a plurality of towers, each said receiver/processor and transmitter unit further comprising at least two half duplex radio transmission/reception devices, each half duplex radio transmission/reception device comprising an FM RTX radio device;

b) a detection beam generated by a detection beam generator/detector connected to each receiver/processor and transmitter unit, said detection beam extending between adjacent towers to define an intruder detection area, said detection beam comprising at least one of: a photo-electric beam, an infrared beam, a laser beam, a microwave beam and a visible light beam;

c) a central unit remote from said towers comprising a radio transmission/reception device communicating with each of the receiver/processors and transmitter units, said central unit further comprising a CPU communicating through said radio transmission/reception device with each receiver/processor and transmitter unit, the central unit further being programmed to send a signal to the receiver/processor and transmitter unit to verify status, and to selectively actuate a remote controlled camera, verify battery voltage, and actuate a microphone/speaker unit connected to the receiver/processor and transmitter unit to hear from and talk to a tower selected from the plurality of towers;

d) an alarm connected to said central unit and responsive to a break in each detection beam, said alarm comprising at least one of: an audible alarm, a visual alarm, a telephone dialer, a printer and a recording device;

e) one said remote controlled camera being connected to at least one receiver/processor and transmitter unit, each said remote controlled camera comprising at least one of: a still photographic camera and a video camera;

f) a solar panel on each of said plurality of towers; and g) a battery source in electrical communication with each solar panel for storage of energy generated by the solar panel, said battery source independently powering the receiver/processor and transmitter unit and the beam generator/detector at each tower.

27. The solar powered perimeter beam security system of claim 26, wherein each said tower comprises a solar panel mounted to a solar mounting bracket, said bracket being mounted to a two-piece swivel bracket at an upper end of said swivel bracket, a lower end of said swivel bracket being mounted to a top portion of a solar base cap, said solar base cap comprising a recessed opening configured to receive electrical connectors extending from said solar panel to said battery source, said solar base cap further comprising a plurality of alignment pegs extending generally downwardly therefrom, said pegs being connected to a top plate, said top plate being configured for being connected to top ends of a frame unit and a plurality of support rods received within rod channels in said frame unit, bottom ends of said frame unit and said support rods being connected to a base unit configured for securement to a ground surface, said frame unit comprising at least one generally vertical and generally planar face, each said face being configured for mounting said receiver/processor and transmitter unit and said beam generator/detector thereto, said frame unit further configured for mountingly receiving a face shield configured to cover each said face and to permit said detector beam to be emitted therethrough.

* * * * *